United States Patent [19]

Chierici

[11] 4,301,741

[45] Nov. 24, 1981

[54] HOPPER CAR OUTLET GATE ASSEMBLY WITH SELF CLEANING GEAR AND RACK ACTUATION ARRANGEMENT

[75] Inventor: Osvaldo F. Chierici, Geneva, Ill.

[73] Assignee: Holland Company, Aurora, Ill.

[21] Appl. No.: 86,644

[22] Filed: Oct. 22, 1979

[51] Int. Cl.[3] ..... B61D 7/20; E05B 65/14

[52] U.S. Cl. ..... 105/282 P; 105/305; 105/308 P

[58] Field of Search ..... 105/282 R, 282 A, 282 P, 105/305, 308 R, 308 P; 74/422

[56] References Cited

U.S. PATENT DOCUMENTS

| | | | |
|---|---|---|---|
| 3,085,517 | 4/1963 | Smith | 105/282 P |
| 3,130,687 | 4/1964 | Smith | 105/282 P |
| 3,138,116 | 6/1964 | Dorey | 105/282 P |
| 3,170,609 | 2/1965 | Dorey | 105/305 X |
| 3,415,204 | 12/1968 | Pase | 105/282 P |
| 3,707,126 | 12/1972 | Nester | 105/282 P |
| 4,006,692 | 2/1977 | Chierici | 105/282 P |
| 4,099,468 | 7/1978 | Adler | 105/282 P |

*Primary Examiner*—Randolph A. Reese

*Attorney, Agent, or Firm*—McWilliams, Mann & Zummer

[57] ABSTRACT

An outlet gate assembly for application to hoppers of railroad hopper cars that is equipped with a self cleaning rack and gear door plate actuation arrangement, in which the outlet gate assembly includes a frame defined by a pair of spaced apart longitudinal frame members that parallel the path of movement of the door plate and a pair of spaced apart transverse frame members joined together with the longitudinal frame members to define the gate outlet port. The frame members are formed to define shelf portions on which the gate door plate underside rides, with the gate underside being equipped with several sets of self cleaning gear and rack mechanisms that couple the gate operating shaft to the gate door plate. The door plate is formed from an UHMW polymer material of dry self lubricating light weight characteristics and is supported across the midportion of the port by a pair of spaced apart support members in parallel relation across the gate outlet port. The gate assembly is equipped with a gravity operated self locking latch arrangement that holds the door plate in its closed position and also provides for sealing of the gate assembly, when the hopper is loaded, for transit.

3 Claims, 10 Drawing Figures

192
194
10
97
92
110
100
88
25
3
96
16
230
62
106
60
166
162
221
160
42
38
154
124
120
118
122
21
180
182
65
18
134
52
121
20
130
116
184
138
34
4
50
136
36
23
40
108
60
62
110
12
98
6
132
22
80
94
14
5
90
95

33
32
65
30
25
121
194
16
12
192
14
40
180
42
35
176
170
36
182
184
34
38
172
178

24
90
94
62
60
28
25
22
54
60
62
96
92
26
33
40
54
42
16
14
88
78
86
84
12
76
82
74
70
190
18
50
51
44
53
52
72

HOPPER CAR OUTLET GATE ASSEMBLY WITH SELF CLEANING GEAR AND RACK ACTUATION ARRANGEMENT

This invention relates to outlet gate assemblies for hoppers of railroad hopper cars, and more particularly, to a door plate mounting and actuation arrangement for such assemblies.

Conventional hopper car outlet gate arrangements are generally arranged to define a continuation of the car hopper sheeting that narrows or funnels down to the outlet port itself which is defined by the gate assembly, and to provide a door plate that moves between open and closed positions to open and close the outlet of the hopper. The door plate itself in equipment of this type has ordinarily been formed from metal, usually steel plating having a thickness of ⅜ths inch. Consequently, outlet gate assembly door plates heretofore have been relatively heavy, and as the gate trackway in which the door plate operates is usually formed from steel, the power requirements to move the door plate from closed to open position when the hopper car is loaded are substantial.

Furthermore, outlet gate door plate actuation arrangements are commonly of the gear and rack type, usually involving an actuating shaft journalled in the gate assembly and mounting several gears that are in meshing relation with corresponding racks that are a fixed part of the door plate. Gear and rack actuation arrangements of this type commonly involve rack plates affixed to the underside of the door plate that have full rack teeth individually formed in the familiar row along the rack plate for gear type meshing relation with the operating shaft mounted gear that is to cooperate therewith to actuate the door plate. Even though the rack plates face downwardly for meshing engagement with the respective gears involved that are disposed below the path of movement of the door plate, foreign matter, coming from such sources as the lading and debris generated from the track bed during transit, tends to collect in the rack plate recesses between adjacent rack teeth, and when the door plate is actuated, such foreign matter is compacted into the indicated rack plate recesses involved by the action of the gear teeth on the rack teeth. As the foreign matter compaction in the indicated rack plate recesses builds up with continued use of the car in service, the rack plate recesses involved provide increasingly limited or reduced operating space for receiving the gear teeth, resulting in a tendency of the door plate to be elevated at the location of the portions of the respective rack plates involved that are engaged by the operating shaft gears, thereby reducing the effectiveness of any gate seal that may be involved about the door plate, increasing operating power requirements due to the misalignment of the door plate that results, and reducing the meshing relation that the operating shaft gears have with the respective rack plates involved with consequent undue wear on both the gears and the rack plates.

A principal object of the present invention is to provide a gate assembly arrangement in which a simplified gate sealing action is provided without requiring special seal components, by having the gate assembly framing form door plate slideway surfaces with which the door plate engages about its perimeter when the door plate is at its closed position, with the gate assembly involving a gear and rack arrangement for actuating the door plate that is self cleaning in nature, and avoids any lifting of the door plate from its slideway forming surfaces that would adversely affect the seal about the door plate.

Another principal object of the invention is to provide a self cleaning gear and rack door plate actuating arrangement that is simple but effective in structural specifics, and that is of general application to outlet gate assemblies of the type in which the door plate is actuated by a gear and rack mechanism.

Another important object of the invention is to apply the racks, of the self cleaning gear and rack devices involved in the actuating assembly, to the door plate in such a manner that the door plate itself is reinforced to the extent that it can be of reduced thickness and thus be of correspondingly reduced weight, thereby reducing operating power requirements for the gate.

Another important object of the invention is to provide an outlet gate arrangement for railroad hopper cars in which the gate door plate is formed from light weight non-metallic material of self lubricating characteristics having also surfacing characteristics which avoid adherence to the door plate of bulk materials to be carried in the hopper.

Yet another important object of the invention is to provide a hopper car outlet gate arrangement of simplified nature that has quick opening characteristics with reduced power requirements, that provides an effective seal about the door plate perimeter when the door plate is in its closed position without the need for a top seal, and that provides a self locking latch arrangement of effective and simplified nature.

Still other objects of the invention are to provide an outlet gate assembly that is economical of manufacture, convenient to install and use, and long lived in operation.

In accordance with the invention, the outlet gate assembly comprises a frame defined by four basic frame components that are shaped to both define the indicated continuation of the hopper car slope sheets as well as the door plate basic slideway forming surfaces. The frame comprises a pair of spaced apart longitudinal frame members that parallel each path of movement of the door plate and a pair of spaced apart transverse frame members joined together with the longitudinal frame members to define the gate outlet port, which is of quadrilateral configuration, that is to be closed by the indicated door plate. The gate assembly longitudinal and transverse frame members are each formed to define shelf portions on which the gate door plate underside rides, with the cooperating surfaces involved to also function as seals against bulk material leakage.

The gate door plate is formed from an ultra high molecular weight polyethylene having a molecular weight of at least two million. The door plate underside is equipped with several spaced apart sets of self cleaning gear and rack devices that couple the gate assembly operating shaft to the gate door plate for actuation of the latter. A pair of vertically disposed door plate support plates are fixed between the gate assembly frame two transverse frame members, in parallel spaced apart relation across the gate outlet port, and support the door plate intermediate the gear and rack devices.

Other objects, uses, and advantages will be obvious or become apparent from a consideration of the following detailed description and the application drawings in which like reference numerals indicate like parts throughout the several views.

Figure 1:
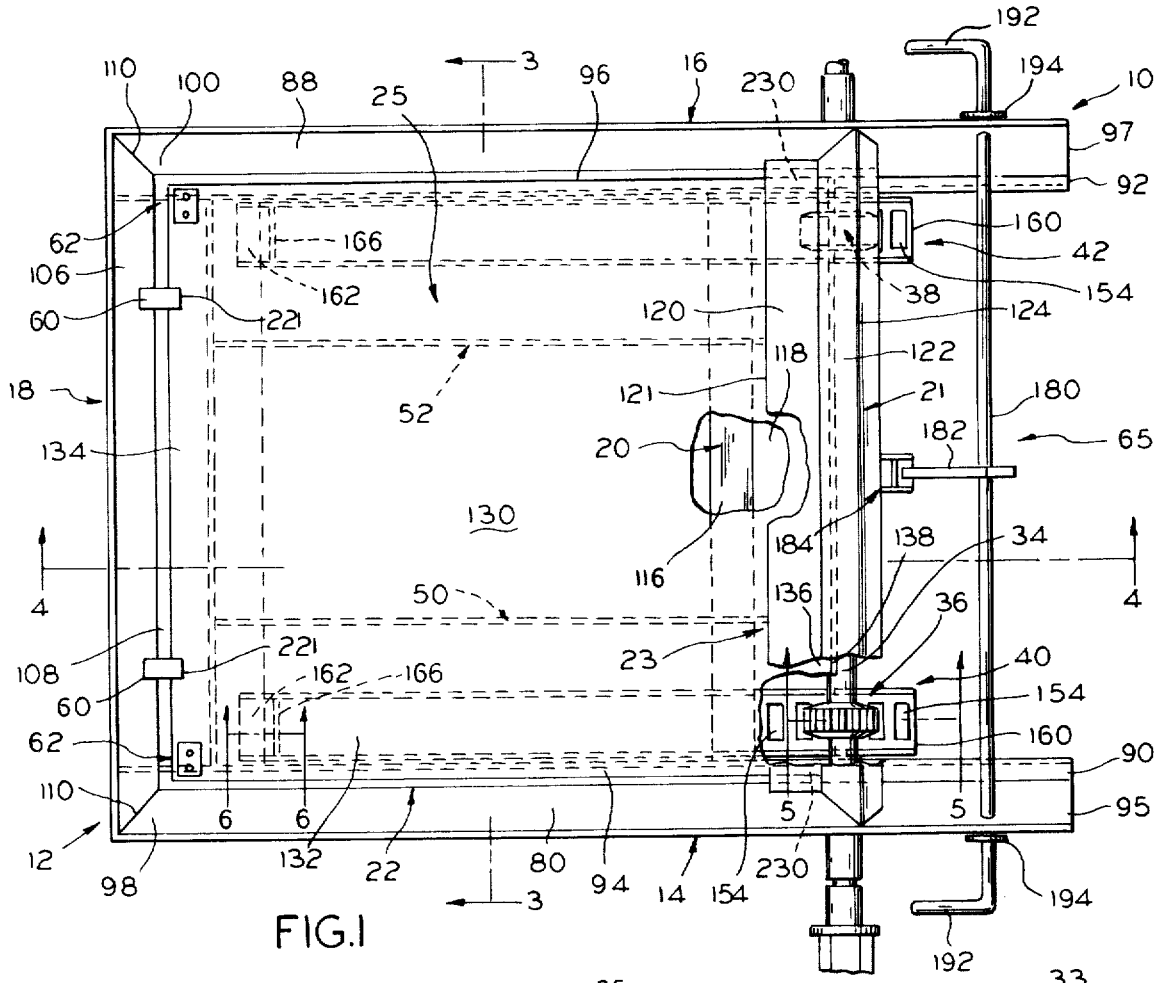
FIG. 1 is a top plan view of an outlet gate assembly arranged in accordance with the present invention, with parts being broken away to expose other parts.
Figure 2:
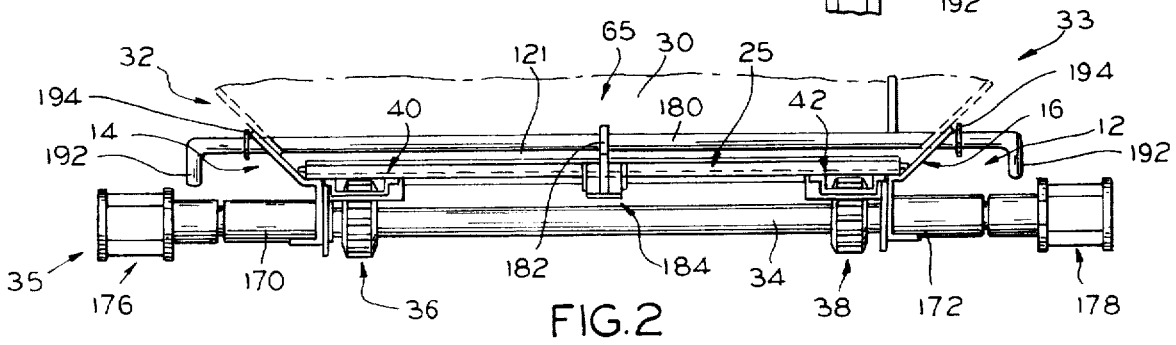
FIG. 2 is a side elevational view of the gate assembly taken from the right hand side of FIG. 1, showing the gate assembly as applied to the lower portions of the hopper car slope sheets.
Figure 3:
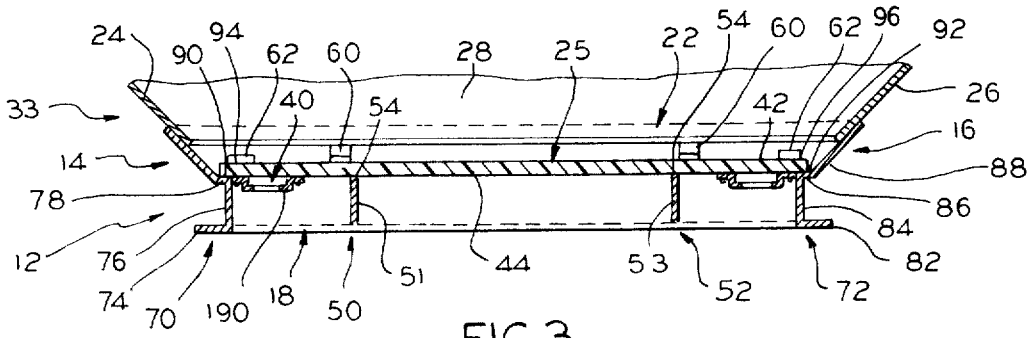
FIG. 3 is a vertical cross-sectional view taken substantially along line 3—3 of FIG. 1, also showing the lower portions of the hopper car slope sheets to which the gate assembly is secured.

However, it is to be distinctly understood that the specific drawing illustrations provided are supplied primarily to comply with requirements of the Patent Laws, and that the invention is susceptible of modifications and variations that will be obvious to those skilled in the art, and which are intended to be covered by the appended claims.

Reference numeral 10 of the drawings generally indicates one embodiment of the invention which comprises a frame 12 formed by a pair of longitudinal frame members 14 and 16 joined together by spaced apart transverse frame member 18 and 20 to define a hopper outlet opening 22 of quadrilateral configuration. Frame 12 above transverse frame member 20 includes bridge member 21, with the transverse frame members 20 and 21 being spaced apart to define a relatively narrow window opening 23 (see FIGS. 4 and 9) in which the gate door plate 25 is operably mounted.

As indicated in FIGS. 2-5, 9 and 10, the frame 12 is attached to the lower edges of the hopper car sheets 24, 26, 28 and 30 that define a railroad car hopper 32, the frame members 14, 16, 18 and 21 being formed to provide continuations of the respective hopper car sheets 24, 26, 28 and 30 that converge in the direction of the gate outlet opening 22 and form the hopper funneling portion 33 therefor.

Figures 4, 5, 6, 7:
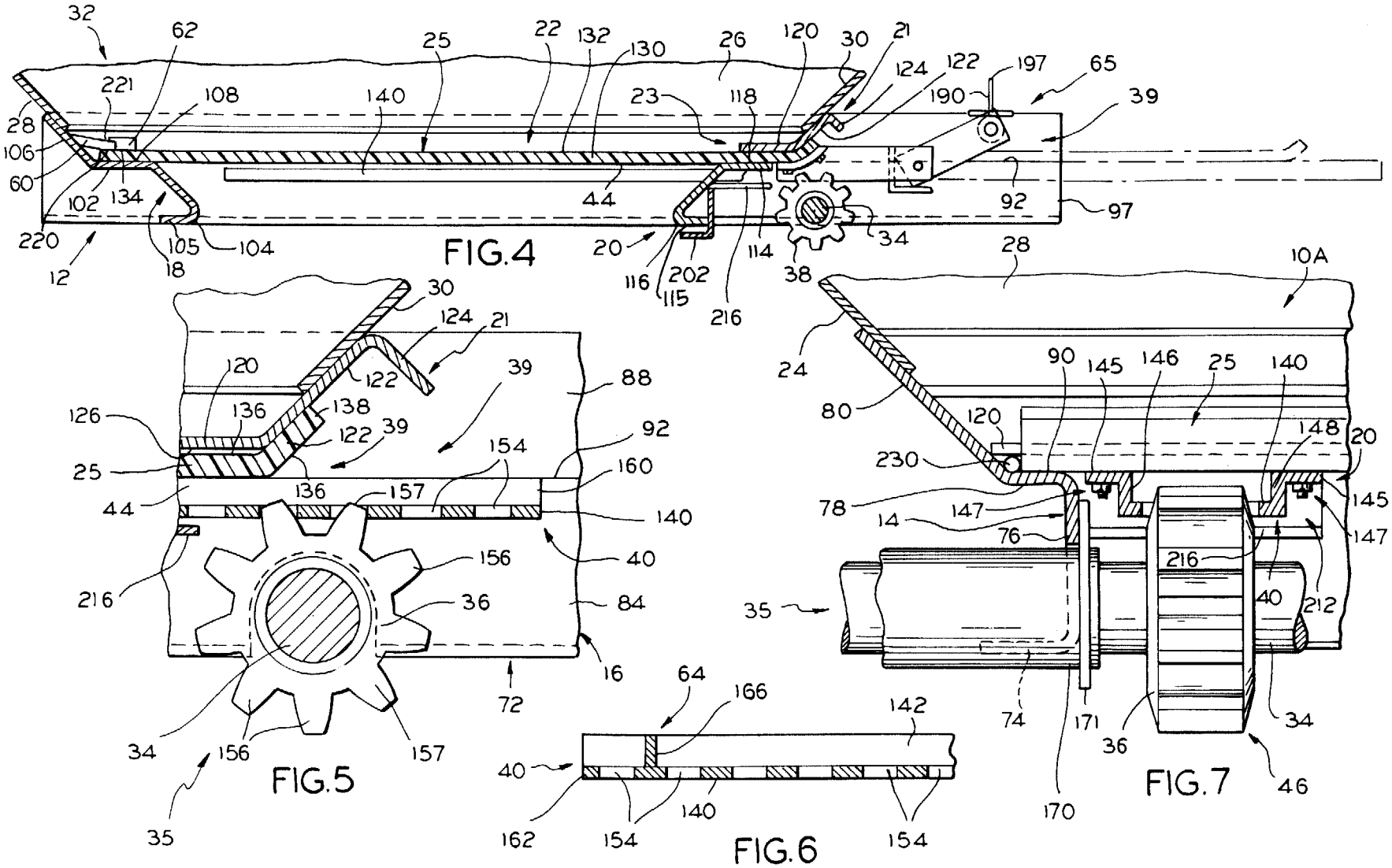
FIG. 4 is a vertical cross-sectional view taken substantially along line 4—4 of FIG. 1, showing also the lower portions of the hopper car slope sheets to which the gate assembly is applied, and indicating also in broken lines the open position of the assembly door plate.
FIG. 5 is a fragmental vertical sectional view taken substantially along line 5—5 of FIG. 1, but showing the parts involved on an enlarged scale with the gear involved shown in elevation, and indicating its meshing application to the self cleaning rack of the gate assembly door plate.
FIG. 6 is a fragmental vertical sectional view taken substantially along line 6—6 of FIG. 1, showing only the end of the door plate rack involved that is adjacent the inner end of the door plate, for purposes of illustrating a bulk material dam associated therewith.
FIG. 7 is a fragmental view similar to that of FIG. 2, with the parts shown generally enlarged and broken away to better illustrate some of the component parts involved.

The gate door plate 25 is mounted for sliding movement between the full line closed position of FIG. 4 and the broken line open position illustrated in the same figure on slideway 39 that is generally planar in configuration and extends through the window opening 23.

Pursuant to the invention, door plate 25 is of one piece molded construction and is formed from the molecularly oriented ultra high molecular weight polyethylene product marketed by Keltrol Enterprises of York, Pa. under the trademark TUFLAR (Grade PL), having a molecular weight lying in the range of from about three million to about nine million. This material, which has a mass that is about one-seventh of steel, is suitably shaped to define the door plate to its illustrated configuration, and among other characteristics in addition to being of dry self lubricating characteristics, this material is pliable but non-stretchable, and is sufficiently compaction resistant to resist any substantial compaction under compressive forces up to its elastic limit, while having a high degree of elastic memory for full return to its original shape after being stressed, up to its elastic limit. This material is also characterized by having its surfacing being resistant to adherence thereto of foreign materials, including bulk materials encountered in the use of railroad hopper cars, such as potash; in addition, this material has a high degree of toughness and long wearing characteristics, and is receptive to fillers in the form of glass, clay, sand, suitable fabrics and alumina for modifying same to adapt door plate 25 for special conditions.

The door plate 25 is moved between its indicated open and closed positions by gear and rack actuation mechanism 35 that comprises operating shaft 34 journalled in the longitudinal frame members 14 and 16 in underlying relation to the frame bridge member 21 and the slideway 39 and having suitably fixed in coaxial relation to same, in the embodiment illustrated, a pair of gears 36 and 38 that are respectively in meshing relation with the respective racks 40 and 42, suitably affixed, to the underside 44 of the door plate. In accordance with the invention, the gear 36 and rack 40 form a self cleaning gear and rack device or set 46, while the gear 38 and rack 42 form a self cleaning gear and rack device or set 48, disposed along either side edge of the door plate 25.

The frame 12 also includes a pair of spaced apart support members 50 and 52 that are fixed between the frame transverse frame members 18 and 20 in parallel relation across the mid portion of the outlet port 22, in substantial parallelism to the longitudinal frame members 14 and 16, and centered on port 22. Members 50 and 52 are vertically disposed plates 51 and 53 each defining an upwardly facing load support surface 54 on which the door plate underside 44 rests.

The transverse frame member 18 is equipped with a pair of spaced apart door plate engaging hold down lugs 60 that engage the door plate in its closed position, and the door plate 25 is equipped with a pair of spaced apart stop blocks 62 that engage the bridge member 21 to limit the outward movement of the door plate 25 from its closed position of FIG. 5, which thus positions the door plate 25 in its fully opened position. The racks 40 and 42 are each equipped with the bulk material dam 64 that is illustrated in FIGS. 1 and 6 for purposes that will become evident as the description proceeds.

Further in accordance with the invention, the gate assembly is equipped with self locking latch device 65 that is adapted for sealing of the gate assembly for loaded rail transit.

Turning now more particularly to the details of the particular gate components involved, the frame members 14 and 16 are shaped to define the respective dependent portions 70 and 72 that are of channel shaped transverse cross-sectional configuration. Thus, the portion 70 of frame member 14 comprises a lower generally horizontally disposed reinforcing flange 74, a vertically disposed web portion 76, and a horizontally disposed flange 78 which merges into slope sheet portion 80 of frame member 14 which is fixed to the car slope sheet 24.

As to the frame member 16, its channel shaped portion 72 comprises lower horizontally disposed flange 82, vertically disposed web 84, and upper horizontally disposed flange 86 which merges into slope sheet portion 88 of frame member 16 that is secured to the car slope sheet 26.

As indicated in FIGS. 2–4, 7 and 10, in accordance with the invention the upper flanges 78 and 86 of the respective frame members 14 and 16 define the respective upwardly facing, coplanar, load support surfaces 90 and 92 on which the respective side edges 94 and 96 of the door plate 25 ride. As indicated in FIG. 1, these load support surfaces 90 and 92 extend from the ends 95 and 97 of the respective frame members 14 and 16 that project outwardly of the window opening 23, to the other ends 98 and 100 of same. Surfaces 90 and 92 are in coplanar relation with surfaces 54 of support members 50 and 52.

The transverse frame member 18 (see FIG. 4) is shaped to define a horizontally disposed land portion 102 that is integral with the downwardly extending apex portion 104 and the upwardly directed slope sheet forming portion 106 to which the car slope sheet 28 is affixed. The land portion 102 of frame member 18 defines upwardly directed load support surface 108 which is coplanar with the load support surfaces 90 and 92. As indicated in FIG. 1, the slope sheet portions 80 and 88 of the respective frame members 14 and 16 are in mitered relation with the slope sheet forming portion 106 of the frame member 18 as at 110, with the land portion 102 and apex portion 104 of member 18 being disposed between the channel shaped portions 70 and 72 of the respective longitudinal frame members 14 and 16.

Transverse frame member 20 is formed to define horizontal land portion 114 and a downwardly extending reinforcing apex portion 116. The land portion 114 forms an upwardly directed load support surface 118 that is coplanar with the load support surfaces 90 and 92 and 108 of the respective frame members 14, 16 and 18.

Figure 9:
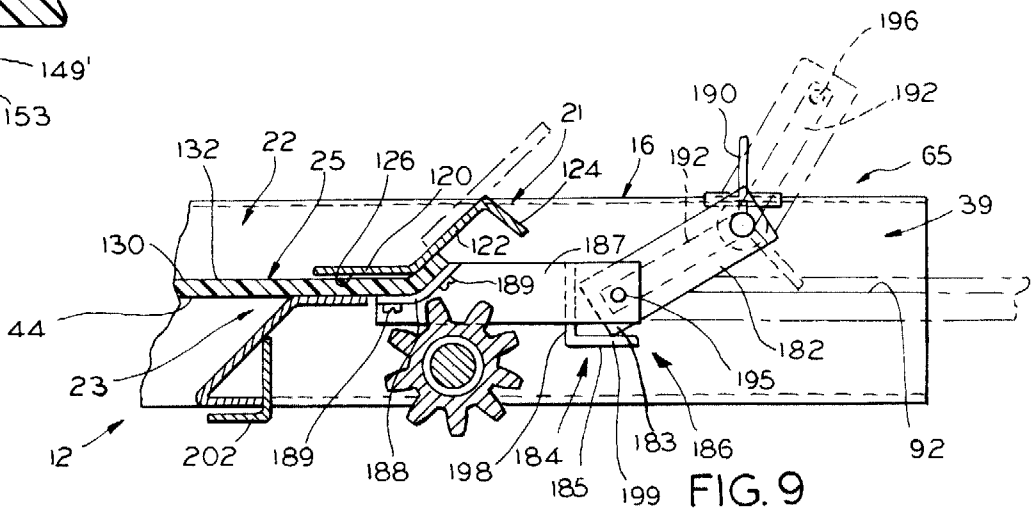
FIG. 9 is a view similar to that of FIG. 4, but on an enlarged scale to better illustrate the gate assembly self locking latch, and showing the latch in open and closed positions.
Figure 10:
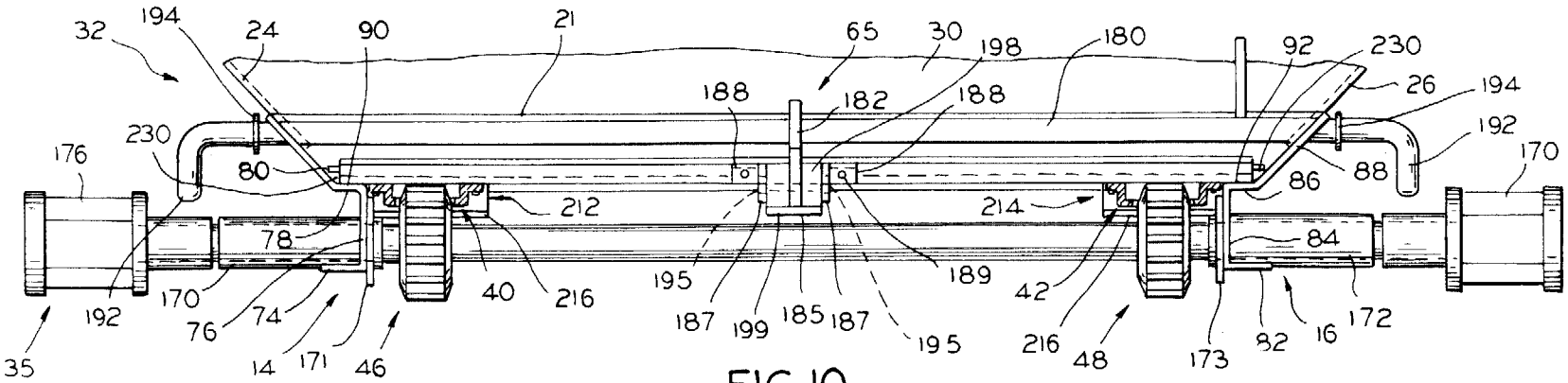
FIG. 10 is a view similar to that of FIG. 2, but on an enlarged scale.

The bridge member 21 comprises horizontally disposed planar land portion 120 that is integral with upwardly directed slope sheet forming portion 122 to which the car sheet 30 is affixed that along its upper edge defines reinforcing apex portion 124. Bridge member 21 is affixed between the slope sheet portions 80 and 88 of the respective longitudinal frame members 14 and 16, as by employing welding, with the land portion 120 thereof being disposed above load support surface 118 of frame member 20, with the spacing to just freely receive the door plate 25, as indicated in FIGS. 4, 5 and 9, and form window opening 23. Land portion 120 thus is in the nature of a header member and defines downwardly facing guide surface 126 that is substantially horizontally disposed and substantially parallels load support surfaces 90 and 92, 108 and 118. In accordance with the invention, the load support surfaces 54, 90, 92, 108, and 118 and guide surface 126 form the slideway 39 for door plate 25, with the door plate 25 normally being disposed below the surface 126 of bridge member 21 under the action of gravity, and with slideway 39 extending through window opening 23.

Door plate 25 comprises non-metallic plate member 130 that is of generally quadrilateral configuration defining top surface 132 in addition to undersurface 44, the respective side edges 94 and 96, front edge 134, and rear edge 136. Plate member 130 is essentially planar in configuration except along its rear edge 136, which has flange portion 138 angled upwardly at the slope of slope sheet portion 122 of bridge member 21 to both form a stop that limits the movement of the door plate toward its closed position and forms a seal that extends longitudinally of the member 21 for the width of the door plate 25, across window opening 23.

Figure 8:
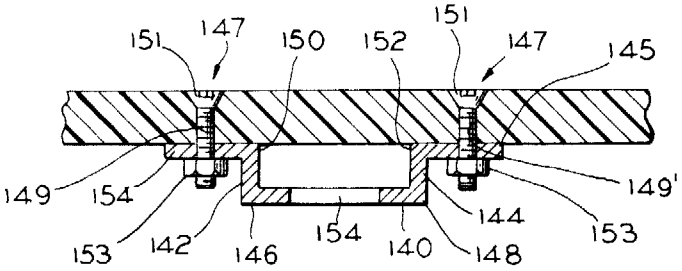
FIG. 8 is a diagrammatic fragmental vertical sectional view of one of the self cleaning racks, viewed as seen in FIG. 3, but on an enlarged scale, and illustrating one way of securing the self cleaning racks to the polymer door plate.

The racks 40 and 42 are of identical construction and each comprise an elongate plate 140 having spaced apart side flanges 142 and 144 along its respective side edges 146 and 148 that are suitably affixed along their top edges 150 and 152 to the door plate. Plate member 140 is of hat shaped transverse cross-sectional configuration such that flanges 142 and 144 are winged as at 145 and fixed to door plate 25 using, for instance, suitable screw and nut assemblies 147 comprising screws 149 having their heads 151 recessed below door plate top surface 130 and having nuts 153 applied thereto (see FIG. 8). Assemblies 147 are spaced along racks 40 and 42 as needed for secure fixing of racks 40 and 42 to door plate 25.

The plate member 140 is thus spaced downwardly from the door plate undersurface 44. Plate member 140 is formed with uniformly spaced through apertures 154 along the length of same that are spaced and proportioned to be received in smooth meshing relation with the teeth 156 of the respective gears 36 and 38.

In accordance with the invention, the spacing of the plate member 140 below the undersurface 44 of the door plate 25, and the length of the teeth 156 radially of the gears 36 and 38 are such that while the teeth 156 in meshing with the through apertures 154, project through same in the manner suggested in FIG. 5, the top lands 157 of teeth 156 are spaced well below the undersurface 44 of gate 25.

It is an important feature of this invention that the gear teeth 156 having this type of meshing relation with the through apertures 154 of plate members 140 so as to have a self cleaning action with regard to the respective racks 40 and 42. Thus, as the door plate actuating mechanism 35 is operated to move the door plate 25 between its open and closed positions, the gear teeth 156 meshing with the respective racks 40 and 42 penetrate or protrude through the rack apertures 154 and withdraw from same to provide a self cleaning action thereon, whereby any foreign materials that may collect on the racks in the area of the apertures 154 will be removed or cleaned away on each operation of the gate assembly to open and close same.

The racks 40 and 42 have outwardly projecting ends 160 that project beyond the operating shaft 34 in the closed position of the door plate 25, and inner ends 162 that extend into adjacency with the edge 134 of the door plate. The racks 40 and 42 adjacent their ends 162 are equipped with the dam 64, which comprise a plate 166 (see FIG. 6) extending transversely across the respective plate members 140 between the respective side flanges 142 and 144 thereof to act as a barrier or dam against the bulk material flow into the racks 40 and 42 when the door plate 25 is moved to its open position.

The shaft 34 has the respective gears 36 and 38 keyed thereto in any suitable manner and is journalled in the respective sleeves 170 and 172 that are in turn fixed, as by welding, to the respective frame members 14 and 16, and specifically their channel shaped portions 70 and 72, respectively, and the respective mounting plates 171 and 173 that are respectively welded to the respective web portions 76 and 84 of frame members 14 and 16.

The shaft 34 has keyed to its respective oppositely directed ends suitable hub structures 176 and 178 adapted to receive the familiar operating lever bars for manual operation of the shaft 34 from either end of same. Of course, the hubs 176 and 178 could also be adapted for cooperation with conventional pneumatic winches or the like for power operation of the shaft 34, as desired.

The frame member 20, in alignment with the movement paths of the racks 40 and 42, is formed to define the respective operating ways 212 and 214 (see FIGS. 2, 7, and 10) to accommodate the movement of the respective racks 40 and 42 relative to the frame member 20. This is conveniently done in the illustrated embodiment by forming the member 20 so that the land 114 in the area of the respective ways 212 and 214 has a dropped down segment 216 that is generally horizontally disposed and positioned at a level below the rack plate members 140. As indicated in FIG. 4, the segments 216 include a segment of the frame member apex portion 116 so that the operating ways 212 and 214 extend fully cross-wise of the frame member 20.

The gate engaging lugs 60 are disposed elevationally so that their undersurfaces 220 (see FIG. 4) slidably receive the forward or front edge 134 of the door plate 25 with some downward bias whereby the front end of the gate is pressed against the land 102 of frame member 18, with door plate edge 134 and the projecting ends 221 of lugs 220 being suitably rounded for camming relation therebetween. As indicated in FIG. 4, the door plate underside 44 and the land 102, and specifically its upwardly facing surface 108, have broad engaging areas of contact when the door plate 25 is in its closed position, for maximum sealing characteristics, with lugs 60 camming door plate 25 thereagainst.

A broad area sealing function is also present along the side edges 94 and 96 of the door plate by reason of the engagement of the gate undersurface 44 with the load support surfaces 90 and 92 of the respective frame members 14 and 16; a similar seal is provided in the broad area of contact between the door plate underside 44 and the land 114 of frame member 20, with the overlying relation of the land 120 of bridge member 21 relative to the rear edge 136 of the gate 126 providing a shield type seal at this area of the gate.

The door plate 25 also effects a seal about its edges in conjunction with load support surfaces 90, 92, 108 and 118 by way of the weight of the lading bearing on the door plate. The weight of the lading bearing against the door plate edges 94, 96, 134 and 136 compresses such door plate edges against the load support surfaces engaged thereby, with the result that the door plate edges deflect somewhat, within the elastic limit of the material employed, to provide continuous contact of the gate undersurfacing 44 with the respective surfaces 90, 92, 108 and 118 for effecting a full surface to surface seal therealong.

Self locking latch device 65 comprises operating rod 180 journalled between frame members 14 and 16 for pivotal movement about a horizontal axis that substantially parallels that of shaft 34. Operating rod 180 has latch arm 182 fixed to same which cooperates at its latching and projecting stub end 183 with catch structure 184 that is suitably fixed to door plate 25 at its edge 136. In the form shown, catch structure 184 comprises angle member 185 defining latch seat socket 186 and fixed between parallel straps 187 that are flanged as at 188 for securement to the door plate 25 by suitable screws 189 or the like.

Operating rod 180 also has fixed to same in vertical alignment with load support surface 92 a stop arm or pin 190 with the latch arm 182 and stop pin 190 being respectively oriented relating to the axis of rod 180 to define a one hundred twenty degree angulation (see FIGS. 4 and 9), in the illustrated embodiment. Operating rod 180 outboard of the respective frame members 14 and 16 has operating handles 192 that are in coplanar relation with each other and with latch arm 182 (see FIG. 9), and that are disposed relative to hubs 176 and 178 for ready hand grasping and operation by the operator free of interference with the respective hubs 176 and 178. Washers 194 fixed to rod 180 keep rod 180 centered relative to catch structure 184.

When the operating rod 180 is positioned so that latch arm end 183 rests on seat 186, assuming door plate 25 is in its closed position, gravity acting on the handles 192 as well as the latch arm 182 holds the operating rod in this position in which seal receiving through openings 195 and 196 formed in the straps 187 and latch arm 182 respectively are aligned (see FIG. 9); in this position, stop pin 190 is vertically disposed (see FIG. 9).

When the seal is removed from openings 195 and 196 or is not present, the operator grasps one of the handles 192 and swings rod 180 clockwise of FIGS. 4 and 9 to bring stop pin 190, and specifically its projecting end 197, into engagement with surface 92, which moves the latch arm 182 and operating rod handles 192 to the over center positions of FIG. 9 for opening of the gate. The gate opening movement brings the door plate flange portion 138 against stop pin 190 to swing rod 180 counterclockwise of FIGS. 4 and 9 to return the masses of latch arm 182 and handles 192 to the other side of the operating rod axis for swinging down under gravity until the latch arm end 183 engages on the top surface 132 of door plate 25. When the gate is returned to closed position, the latch arm rides along gate surface 132, over flange portion 138 and across the vertical flange 198 of angle member 185 to drop on the horizontal flange 199 of same and thus seat on latch seat 184, to hold the gate against any substantial opening movement when the hopper is empty.

The latch arm end 183 may be rounded for smooth riding on the door plate 25.

At the side edges 94 and 96 of the gate under the land 120, a suitable filler element 230 (see FIG. 10) is fixed in place to deter lading leakage at this area of the gate.

The door plate 25 is moved to its closed position shown in the drawing FIGS. 1, 4 and 9 using a motivating mechanism or device appropriate for the gates 10. In the particular gate arrangement illustrated, assuming the door plate 25 is in its open position with latch arm 182 riding on its top surface 132, the familiar operator lever bar is applied to one of the socket structures 176 and swung in the appropriate direction (counterclockwise of FIGS. 4 and 9), whereby shaft 34 is rotated and the gears 36 and 38 coact with the respective racks 40 and 42 to convert the rotary motion of the shaft 34 and gears 38 and 38 into linear movement of the door plate 25. As the door plate 25 moves towards its closed position of FIGS. 1 and 4, the undersurface 220 of the gate hold down lugs 60 engage the top surface 132 of the door plate in camming relation thereto to bias the forward edge 134 of the gate into firm sealing contact arrangement with the land 102 of frame member 18. Movement of the gate to its closed position is continued until sealing flange 138 is brought firmly against bridge member slope sheet portion 122 to effect the desired bulk material seal across the window opening 23. In this position, latch arm 182 will be reseated in seat 184.

When the lading load is applied to the hopper car, there is a substantially complete seal about the perimeter of door plate 25, by reason of the weight of the lading bearing on the door plate, and the engagement of the gate undersurfacing 44 with the load support surfaces 90, 92, 108 and 118. The land 120 also forms the indicated shielding seal which is reinforced by the sealing flange 138 of the door plate.

The usual boot is secured across the outlet port 22 under the door plate 25 by suitable connection with the lower flanges 105 and 115 defined by the respective frame members 18 and 20, angle member 202 being applied to frame member 20 for this purpose.

Assuming that the loaded hopper 33 is to be opened, after the gate locking seals and the conventional boot are removed, and operating rod 180 is disposed in the overcenter unlatched position of FIG. 9, the indicated operator's lever is applied to one of the sockets 176 and the operating shaft 34 rotated clockwise of FIGS. 4 and 9 to move the door plate 25 to the right of FIGS. 4 and 9. Gears 36 and 38 thus cooperate with the racks 40 and 42 to convert the rotary motion of the shaft 34 and gears 36 and 38 into the necessary linear movement of the door plate 25. As movement of the door plate 25 is initiated, the door plate 25 slides to the right of FIGS. 1, 4 and 9 relative to the frame 12, with the door flange 138 engaging stop pin 190 to flip the operating rod 180 counter-clockwise of FIG. 9 and bring latch arm 182 into engagement with door plate surface 132, on which latch arm rides as opening movement of door plate 25 continues fully to the right relative to the frame 12.

In the fully opened position of the gate 34, the door plate 25 has the relative position indicated in broken lines in FIG. 4, with the stop blocks 62 engaging the edge 121 of land 120 of bridge member 21 to limit movement of the door plate 25 outwardly of the window opening 23. The projection of the frame members 14 and 16 to the right of the window opening 23 that is indicated in FIGS. 1 and 4 provides the needed support of the door plate 25 by the frame 12 in the fully opened position of the door plate.

As indicated, it is a feature of the invention that when the door plate 25 is being moved, the gear and rack devices 46 and 48 involved in actuating the door plate act in a self cleaning manner to maintain the racks involved free of clogging or blocking that would adversely affect the operation of the door plate or change its elevational position relative to the frame 12. This action occurs automatically for both opening and closing movement of the door plate. Further, racks 40 and 42 being located on the underside of the door plate 25, they are shielded from the lading.

The special racks employed along either side edge of the door plate also serve the additional function of reinforcing the door plate, at two spaced apart areas for each rack, that extend longitudinally of the path of movement of the door plate.

As door plate 25 is formed from the above mentioned UHMW polymer, its surfacing is characterized by resistance to adherence thereto of foreign matter (including the bulk materials normally encountered in rail transit), while being self lubricating in nature and providing a coefficient of sliding or dynamic friction relative to the metal components involved on the order of 0.02. The material in question, in addition to being high strength wear resisting material, also is characterized by effecting on the load support surfaces 54, 90, 92, 108 and 118 (that it moves with respect to) a polishing or honing resurfacing action such that after a period of normal use, the metal surfacings involved take on a mirror like finish whereby the cooperating metallic surface involved becomes effectively resistant against further wear. Any foreign material that becomes caught between the two surfaces involved seems to become embedded in the door plate surfacing and thus is in a position to avoid any wearing action on the metallic surfaces involved. As indicated, since the material from which the liner is made resists adherence thereto of foreign matter, such foreign matter does not accumulate on the door plate and it is only grit and the like that becomes trapped between the surfaces that is subject to the embedding action indicated.

The material from which the door plate 25 is formed is also corrosion resistant, and in the resurfacing of the gate undersurface areas engaged thereby, not only resurfaces such areas, but protects these portions of the gate assembly from corrosion and insures low coefficient of sliding friction characteristics that not only make for continued easy operation of the gate in use, but also make for reduced coefficient of sliding friction characteristics as use continues since polymer to polymer sliding surfaces will be involved. These advantages are further augmented by the resulting relative light weight of the door plate 25, which due to the reinforcement of the door plate by racks 40 and 42, and its support by surfaces 54, 90, 92, 108 and 118, may have a thickness of as litle as one-half inch.

The easy door plate opening and closing action provided significantly reduces stress loading of mechanism 35, and makes feasible hand crank operation of shaft 34 in place of the crank arrangement represented by hub structures 176 and 178 and the conventional lever bar for operating same.

The foregoing description and the drawings are given merely to explain and illustrate the invention and the invention is not limited thereto, except insofar as the appended claims are so limited, since those skilled in the art who have the disclosure before them will be able to make modifications and variations therein without departing from the scope of the invention.

What is claimed is:

1. In a hopper outlet gate assembly for bulk material carrying railroad hopper cars in which the car hopper has an outlet opening, with the assembly including a frame forming an outlet port of quadrilateral configuration, a door plate of quadrilateral configuration for closing the port, a slideway for the door plate, which slideway extends in a substantially horizontal plane sidewise and across the outlet port, with the door plate defining opposed side edge portions that parallel the slideway and define the width of the door plate, and gear and rack means for moving the door plate longitudinally of the slideway between a first position in which it is disposed across the port to close same and a second position in which it is disposed to one side of the port to open same for discharge of the bulk materials therefrom, the improvement wherein said frame comprises:

a pair of spaced apart parallel longitudinal frame members paralleling the slideway, a pair of spaced apart parallel transverse frame members fixed between said longitudinal frame members to form the outlet port, said frame members being formed to each define a shelf portion on which the door plate rides, said frame member shelf portions being in substantial coplanar relation and being coplanar with the slideway, with the door plate side edge portions riding on the shelf portions of said longitudinal frame members, respectively, in sliding relation thereto, and with the slideway having a centerline extending longitudinally thereof that is centered between said longitudinal frame member shelf portions, said longitudinal frame members projecting laterally of the port from one side of the port beyond one of said transverse members, a bridge member fixed between said longitudinal frame members above and spaced from said one transverse member, said bridge member defining a header portion overlying said one transverse member shelf portion in closely spaced relation thereto to define a window opening through which the slideway extends and in which said door plate is mounted in closely spaced relation to said header portion, said door plate being proportioned lengthwise of said slideway to project exteriorly of the assembly through the window opening to define an outwardly projecting portion thereof when said door plate is in its first position, said gear and rack means comprising:

a shaft journalled in said frame below the slideway and adjacent said bridge member, and extending crosswise of the slideway and paralleling said transverse frame members, and a pair of gear and rack sets coupling said shaft to said door plate for translating rotational movement of said shaft into linear movement of said door plate between said positions, said gear and rack sets each comprising:

an elongate plate member fixed to the underside of said door plate and extending longitudinally of the slideway, said plate members being spaced from and vertically below said door plate and paralleling the slideway, said plate members being disposed between said shelf portions of said longitudinal frame members and being in spaced apart coplanar relation transversely of the door plate, and being substantially equally spaced from the slideway longitudinal centerline, said plate members each being formed to define a row of uniformly spaced apart through apertures, which row extends longitudinally of the respective said plate members, first and second gears keyed to said shaft in coaxial relation thereto, with said first gear being below one of said plate members and defining gear teeth in meshing relation with said row of apertures of said one plate member, and with said second gear being below the other of said plate members and defining gear teeth in meshing relation with said row of apertures of said other plate member, said meshing relation of said gear and rack sets comprising coupling means for effecting linear movement of the door plate between said positions, through said sets, on rotational movement of said shaft, and means for rotating said shaft in either direction to move the door plate between said position, said teeth of each of said gears being spaced from and below the door plate and protruding through, respectively, the respective said apertures of said plate members, respectively, in self cleaning relation thereto from the underside of same, when in said meshing relation, respectively, with the respective plate members, whereby said sets are self cleaning on rotation of said shaft, by the linear movement effecting action of said coupling means, and said sets in being on the underside of the door plate, the door plate thereby remains free of lifting bias induced by operation of said coupling means whereby the door plate rides level with the slideway, said plate members of said sets having end portions extending adjacent to said door plate one edge, with said plate members each including adjacent said end portions of same a bulk material dam for blocking bulk material discharge into said sets.

2. The improvement set forth in claim 1 wherein:

said door plate in the gate first position has one edge of same in overlying relation to the other transverse frame member shelf portion and the other edge of same disposed exteriorly of said window opening, said door plate carrying adjacent said one edge of same on the upper side of same one or more stops proportioned to engage said bridge member in the second position of said door plate.

3. The improvement set forth in claim 1 including a self operating door plate latch device comprising:

an operating rod journalled between said longitudinal frame members for pivotal movement about a horizontal axis, and disposed exteriorly of the gate assembly adjacent said window opening and above the level of the slideway, said operating rod extending transversely of said slideway in parallelism to said shaft and being spaced from said shaft in the direction of the door plate second positions relative to said slideway, said operating rod having a single latch arm and a pair of operating handles made fast thereto extending transversely thereof in coplanar relation on the same side of the operating rod, a latch seat carried by the door plate projecting portion and disposed adjacent to and below the plane of the slideway, said latch seat being disposed relative to the door plate such that when the door plate is in its first position, said latch seat is disposed between said shaft and said operating rod, said operating rod latch arm and said latch seat being substantially aligned with the longitudinal centerline of the slideway and intermediate of and spaced from said plate members of said gear and rack sets, said latch arm on pivotal movement of said operating rod about its said horizontal axis swinging in a vertical plane that is substantially aligned with the slideway longitudinal centerline, with said latch seat being substantially aligned with said latch arm vertical plane, and defining a catching socket directed toward the portion of said operating rod to which said latch arm is made fast, said latch arm having a projecting stub end and being proportioned in length such that when the door plate is in its first position, said latch arm stub end will move into and out of said latch seat on pivotal movement of said operating rod about its said axis, and when said latch arm stub end is resting in said latch seat under gravity acting on same and said handle, said latch arm is at an acute downwardly directed angle relative to the plane of said slideway for bracing the door plate against movement from its first position to its second position, said operating handles being respectively located outboard of said longitudinal frame members, respectively, a single stop arm made fast to said operating rod in transversely extending projecting relation therefrom and located in vertical alignment with the shelf portion of one of the longitudinal frame members, said stop arm being oriented relative to the plane of said latch arm and said operating handles to be vertically disposed and project upwardly of the operating rod when said latch arm stub end engages said latch seat, said stop arm having a length radially of said operating rod to engage the shelf portion of said one longitudinal frame member, when one of said operating handles is moved to pivot said operating rod to move said stop arm thereagainst, and dispose said latch arm and said operating handle in an over center position relative to said operating rod, whereby gravity acting on said latch arm and said operating handles hold said latch arm to be directed upward of and away from the level of said slideway, whereby when said door plate is moved toward its second position, it engages said stop arm to return said latch arm from said overcenter position thereof for riding on the upper side of the door plate, and when the door plate is moved back to its first position, said latch arm rides over the door plate to seat, under gravity, its stub end in said catching socket.

* * * * *